US011460162B2

(12) United States Patent
Ding

(10) Patent No.: US 11,460,162 B2
(45) Date of Patent: Oct. 4, 2022

(54) LAMPSHADE AND FLAMELESS CANDLE COMPRISING THE SAME

(71) Applicant: Nantong Ya Tai Candle Arts & Crafts Co., Ltd., Nantong (CN)

(72) Inventor: Yingqi Ding, Nantong (CN)

(73) Assignee: NANTONG YA TAI CANDLE ARTS & CRAFTS CO., LTD., Nantong (CN)

( * ) Notice: Subject to any disclaimer, the term of this patent is extended or adjusted under 35 U.S.C. 154(b) by 0 days.

(21) Appl. No.: 17/465,884

(22) Filed: Sep. 3, 2021

(65) Prior Publication Data

US 2022/0221118 A1 Jul. 14, 2022

(30) Foreign Application Priority Data

Jan. 14, 2021 (CN) ..... 202110048297.9

(51) Int. Cl.

| | |
|---|---|
| ***F21S 10/04*** | (2006.01) |
| ***F21S 6/00*** | (2006.01) |
| ***F21V 14/06*** | (2006.01) |
| ***F21V 23/04*** | (2006.01) |

(52) U.S. Cl.

CPC ..... *F21S 10/046* (2013.01); *F21S 6/001* (2013.01); *F21V 14/06* (2013.01); *F21V 23/04* (2013.01)

(58) Field of Classification Search

CPC ..... F21S 10/04; F21S 10/046; F21S 6/001
See application file for complete search history.

(56) References Cited

U.S. PATENT DOCUMENTS 6,017,139 A * 1/2000 Lederer ..... F21S 6/001 362/394
2007/0177393 A1* 8/2007 Hirata ..... F21V 1/00 362/235
2015/0036348 A1* 2/2015 Dong ..... F21V 9/08 362/372
2015/0192283 A1* 7/2015 Chien ..... F21S 10/00 362/253
2015/0204530 A1* 7/2015 Lee ..... F21S 10/046 362/282
2015/0338086 A1* 11/2015 Patton ..... F21V 14/08 362/277
2015/0362141 A1* 12/2015 Chen ..... F21S 9/02 362/183
2016/0146414 A1* 5/2016 Dong ..... F21S 6/001 362/372
2017/0167677 A1* 6/2017 Patton ..... F21S 10/046
2017/0211767 A1* 7/2017 Baeza ..... F21S 9/03
2017/0234496 A1* 8/2017 Wang ..... F21V 14/06 362/277
2018/0306396 A1* 10/2018 Patton ..... F21V 19/0055

(Continued)

FOREIGN PATENT DOCUMENTS

CN 109404846 A * 3/2019 ..... F21S 10/046

OTHER PUBLICATIONS

Fan, Flame piece suspended electronic candle lamp, Mar. 1, 2019, CN-109404846-A (Year: 2019).*

*Primary Examiner* — Jong-Suk (James) Lee
*Assistant Examiner* — James M Endo
(74) *Attorney, Agent, or Firm* — Matthias Scholl P.C.; Matthias Scholl

(57) ABSTRACT

A lampshade includes a head cover, a shell, and a swing assembly. The head cover is secured on the shell and the swing assembly is disposed in the shell.

6 Claims, 3 Drawing Sheets

(56) References Cited

U.S. PATENT DOCUMENTS

| | | | | |
|---|---|---|---|---|
| 2018/0347772 | A1* | 12/2018 | Lin | F21S 9/02 |
| 2019/0063703 | A1* | 2/2019 | Hurduc | F21V 14/06 |
| 2019/0072251 | A1* | 3/2019 | Carpintero | F21V 14/06 |

* cited by examiner

LAMPSHADE AND FLAMELESS CANDLE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202110048297.9 filed Jan. 14, 2021, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a lampshade and a flameless candle comprising the same.

Traditional flaming candles pose potential fire hazards. Flameless candles are currently available on the market and present in a variety of shapes to produce a realistic effect of flickering lights. The flameless candles include a flame sheet secured on a candle cap through an iron wire. The flame sheet can simulate the effect of free swing when the flame sheet is lighting, but swings at a small angle, which cannot produce a realistic effect of flickering lights. In addition, the swinging of the flame sheet creates a frictional resistance between the flame sheet and the iron wire. Each time a driving device drives the flame sheet, the flame sheet can only swing once or twice limited by the frictional resistance. Therefore, the driving device requires continuous energy to drive the flame sheet to swing, which is energy-consuming, thus shortening the battery lifespan of the flameless candles.

SUMMARY

The disclosure provides a lampshade comprising a head cover, a shell, and a swing assembly; the head cover is secured on the shell and the swing assembly is disposed in the shell.

In a class of this embodiment, the head cover comprises a pedestal and a flame body disposed on the pedestal; and the head cover comprises a hollowed out bottom surface.

In a class of this embodiment, the shell comprises a hollow column; an inner wall of the hollow column comprises a vertical limit groove; and an outer wall of the hollow column comprises a vertical notch and a horizontal notch perpendicular to the vertical notch.

In a class of this embodiment, the swing assembly comprises a lamp bead device, a swing frame, and a circular base plate; the lamp bead device comprises a lamp bead and a support frame disposed aslant with respect to the swing frame; the support frame comprises a first rod and a second rod extending from a side edge of the first rod; the lamp bead is secured on the first rod and the second rod extends away from the lamp bead; the circular base plate comprises a U-shaped groove for accommodating an electromagnet; the lamp bead device is disposed on one side of the U-shaped groove; the swing frame is disposed vertically with respect to the pedestal; the swing frame comprises a through hole and the second rod is disposed through the through hole.

In a class of this embodiment, a part of the second rod abutting against an inner surface of the swing frame comprises a recess.

In a class of this embodiment, the swing frame comprises a top portion and a bottom portion; a convex lens is disposed on the top portion and is inclined toward the lamp bead; a pendulum is disposed on the bottom portion and comprises a magnet; the magnet and the electromagnet are disposed oppositely to each other.

In a class of this embodiment, the lamp bead is inclined at an angle of 20°-40°.

In a class of this embodiment, the lamp bead device and the swing assembly are separately disposed in the shell by a snap fit.

In another aspect, the disclosure also provides a flameless candle comprising the lampshade, a housing, and a base; the housing and the base are fixedly secured to the lampshade; the base comprises a battery housing and a control switch.

The following advantages are associated with the lampshade and the flameless candle of the disclosure:

1. The magnet and the electromagnet are disposed oppositely to each other, which makes the swing frame keep swinging, improving the realistic simulation effect of flickering flames; and 2. The part of the second rod abutting against the inner surface of the swing frame comprises a recess; the recess is configured to limit changes in position of the swing frame, so that the swing frame can stably swing on the second rod for a long time.

Figure 1:
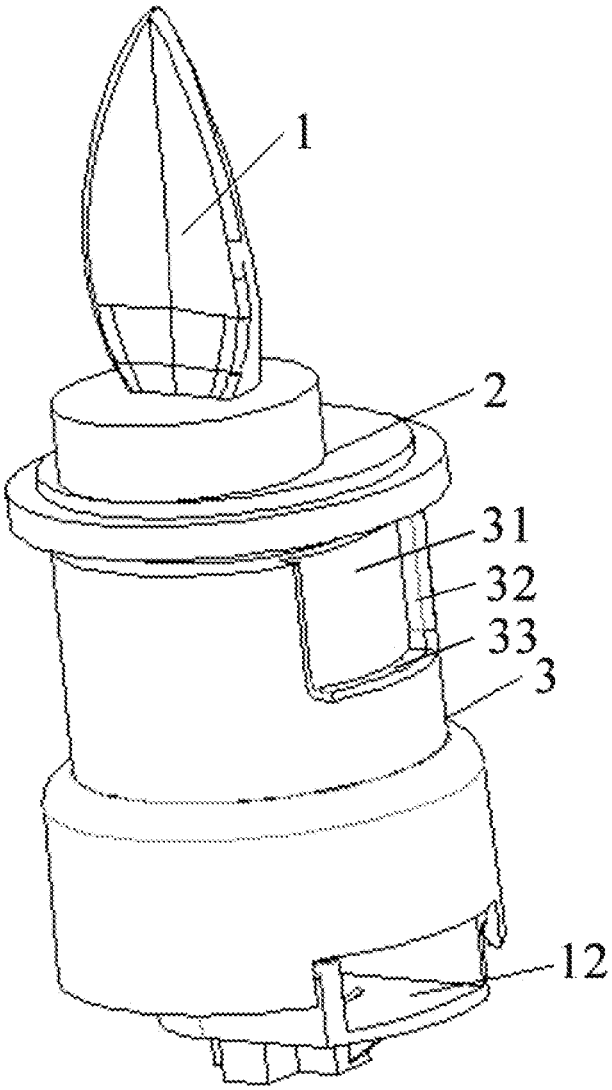
FIG. 1 is a perspective view of a lampshade according to one embodiment of the disclosure.

In the drawings, the following reference numbers are used: 1. Flame body; 2. Pedestal; 3. Shell; 4. Swing frame; 5. Circular base plate; 6. First rod; 7. Lamp bead; 8. Second rod; 9. Recess; 10. Convex lens; 11. Pendulum; 12. U-shaped groove; 31. vertical limit groove; 32. Vertical notch; 33. Horizontal notch.

DETAILED DESCRIPTION

To further illustrate the disclosure, embodiments detailing a lampshade and a frameless candle comprising the same are described below. It should be noted that the following embodiments are intended to describe and not to limit the disclosure.

Figure 2:
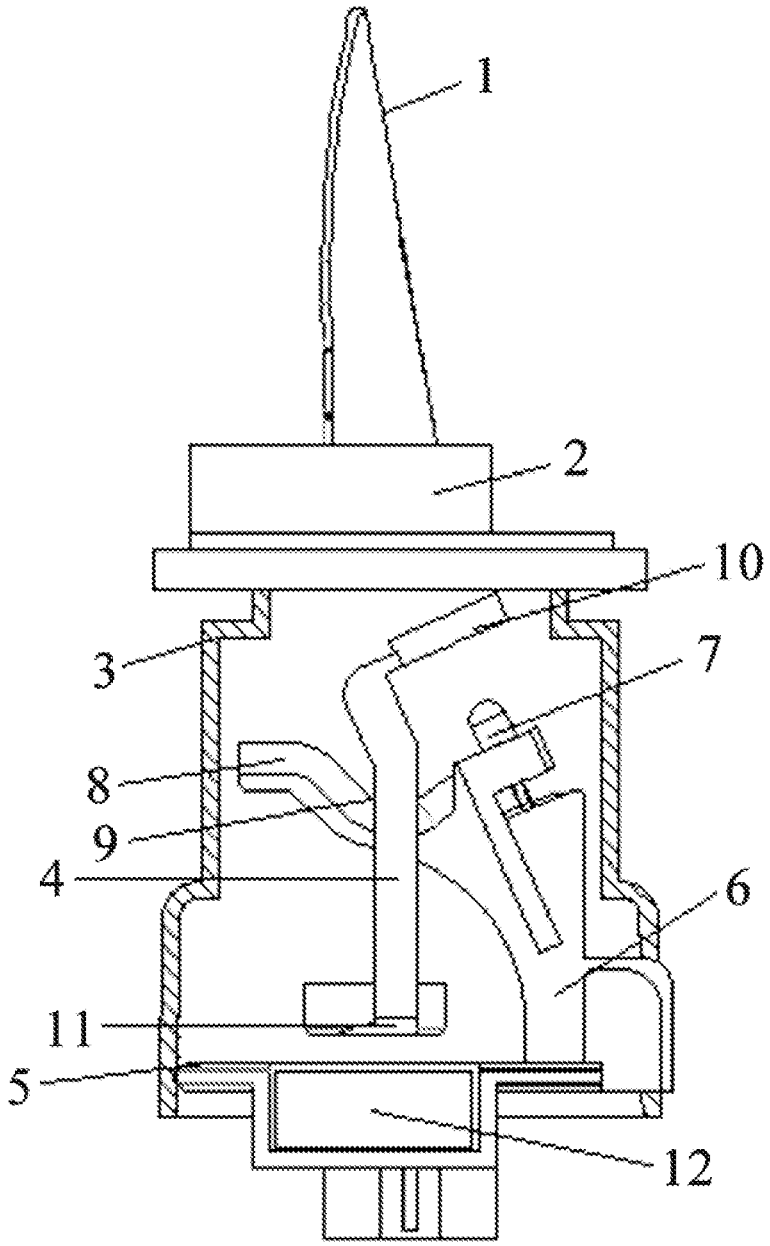
FIG. 2 is a side cross-sectional view of a lampshade according to one embodiment of the disclosure.
Figure 3:
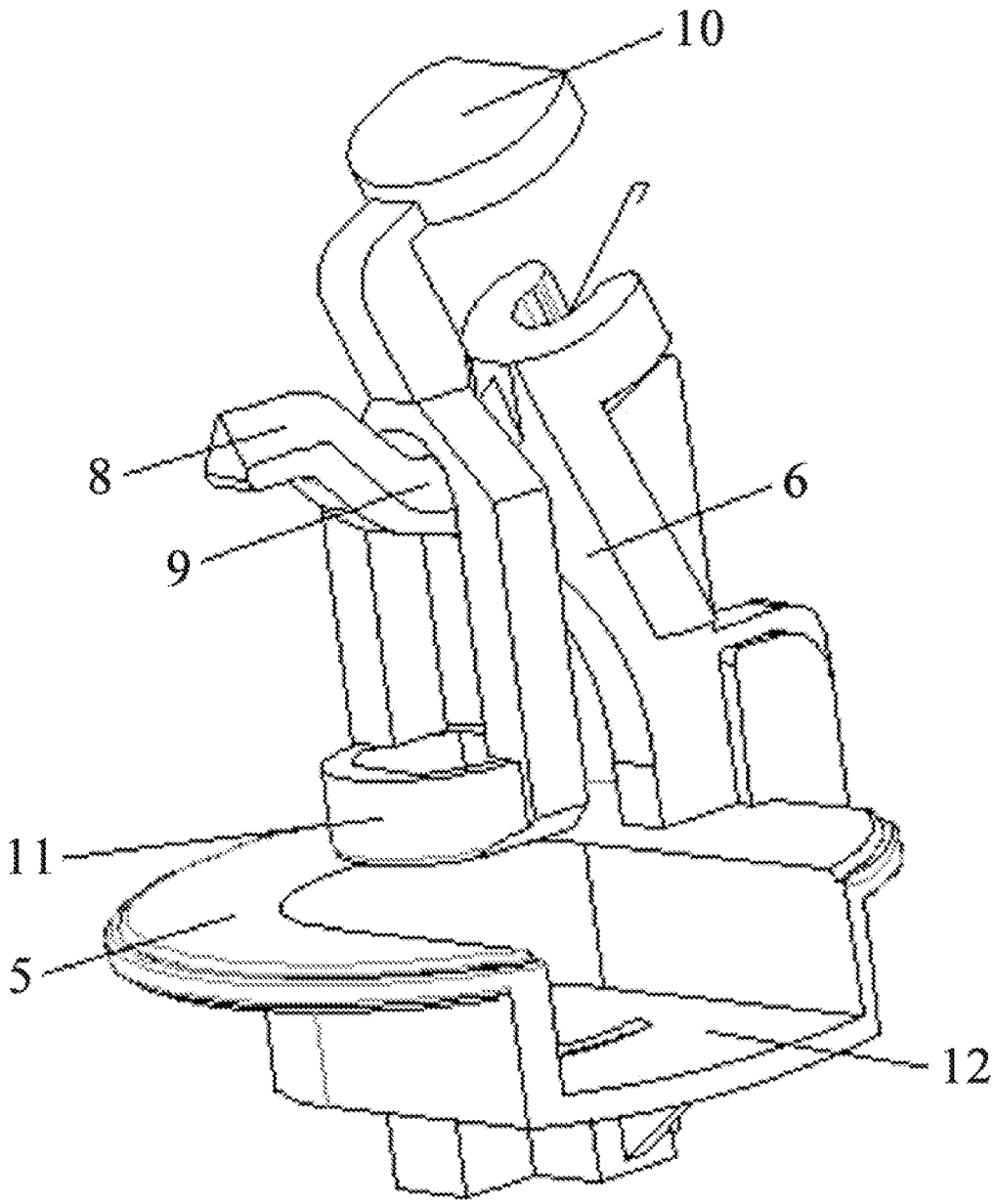
FIG. 3 is a perspective view of a swing assembly according to one embodiment of the disclosure.

Referring to FIGS. 1-3, a lampshade comprises a head cover, a shell 3, and a swing assembly; the head cover is secured on the shell 3 and the swing assembly is disposed in the shell 3.

In certain embodiments, the head cover comprises a pedestal 2 and a flame body 1 disposed on the pedestal 2; and the head cover comprises a hollowed out bottom surface.

The flame body 1 comprises a first curved surface and a second curved surface. The first curved surface is aslant disposed on the pedestal 2 with respect to the second curved surface. The second curved surface is vertically disposed on the pedestal 2. The first curved surface and the second curved surface each comprise a top edge, two side edges, and a bottom edge; corresponding top edges and side edges are bonded to each other to form a first cavity; the bottom edge of the first curved surface and the connection line of two end points of the bottom edge of the first/second curved surface form a semicircular opening. The pedestal 2 comprises a first hollow column configured to accommodate a lamp bead of the flameless candle. The first hollow column comprises a first through hole corresponding to the semi-circular opening in shape and size. The flame body 1 comprises the first curved surface and the second curved surface, and the lamp bead of the flameless candle is disposed in the first cavity formed by the first curved surface and the second curved surface, so that the light emitted from the lamp bead of the flameless candle irradiates the special-shaped head cover, and the emergent light scatters on the inner surface of the second curved surface, thereby producing a flame effect viewed from outside of the second curved surface. At the same time, the reflected lights generated on the inner surface of the second curved surface is converged on the inner surface of the first curved surface, thereby producing another flame effect viewed from outside of the first curved surface. The entire special-shaped head cover adopts a shape of a candle light, which can achieve a three-dimensional display of a realistic flame of a candle light.

In certain embodiments, the shell 3 comprises a second hollow column; the inner wall of the second hollow column comprises a vertical limit groove 31; and the outer wall of the second hollow column comprises a vertical notch 32 and a horizontal notch 33 perpendicular to the vertical notch.

In certain embodiment, the swing assembly comprises a lamp bead device, a swing frame 4, and a circular base plate 5. The lamp bead device comprises a lamp bead 7 and a support frame disposed aslant with respect to the swing frame 4. The support frame comprises a first rod 6 and a second rod 8 extending from a side edge of the first rod 6. The lamp bead 7 is secured on the first rod 6 and the second rod 8 extends away from the lamp bead 7. The circular base plate 5 comprises a U-shaped groove 12 and an electromagnet is disposed in the U-shaped groove 12. The lamp bead device is disposed on one side of the U-shaped groove 12. The second rod 8 is disposed through a through hole of the swing frame 4, so that the swing frame 4 is vertically hung on the second rod 8.

In certain embodiments, a part of the second rod 8 abutting against the inner surface of the swing frame 4 comprises a recess 9. The recess 9 is configured to limit changes in position of the swing frame 4, so that the swing frame 4 can swing stably on the second rod 8 for a long time.

In certain embodiments, the swing frame comprises a top portion and a bottom portion. A convex lens 10 is disposed on the top portion and is inclined toward the lamp bead 7. A pendulum 11 is disposed on the bottom portion and comprises a magnet. The magnet and the electromagnet are disposed oppositely to each other, so that the swing frame can keep swinging for a long time to produce a realistic effect of flickering lights.

In certain embodiments, the lamp bead 7 is inclined at an angle of 20°-40°.

In certain embodiments, the lamp bead device and the swing assembly are separately disposed in the shell by a snap fit.

In certain embodiments, a flameless candle comprises the lampshade, a housing, and a base. The housing and the base are fixedly secured to the lampshade. The base comprises a battery housing and a control switch.

The working principle of the flameless candle is detailed as follows: when in use, the control switch on the base of the bottom part of the housing is turned on, allowing the battery to provide steady DC power to the electromagnet. The electromagnet and the magnet are disposed oppositely to each other. When the flameless candle is energized, a repulsive magnetic field is generated, causing the swing frame 4 to swing back and forth on the U-shaped groove 12. When a power supply is turned on, the lamp bead 7 turns on and emits light. The light after passing through the convex lens 10 is known as swing light. The swing light with various brightness changes are irradiated on the head cover, to produce a realistic flickering effect of the flames.

In the flameless candle of the disclosure, the magnet and the electromagnet are disposed oppositely to each other, which makes the swing frame keep swinging, thus improving the realistic simulation effect of flickering flames and achieving a three-dimensional display of a realistic flame of a candle light. The part of the second rod abutting against the inner surface of the swing frame comprises a recess. The recess is configured to limit changes in position of the swing frame, so that the swing frame can stably swing on the second rod for a long time.

It will be obvious to those skilled in the art that changes and modifications may be made, and therefore, the aim in the appended claims is to cover all such changes and modifications.

What is claimed is:

1. A lampshade for simulating a flickering flame of a flameless candle, the lampshade comprising a head cover, wherein the head cover comprises a pedestal and a flame body disposed on the pedestal, the pedestal comprising a hollowed-out bottom;

a shell connected to the hollowed-out bottom and comprising a hollow interior defining a longitudinal axis, and a swing assembly disposed in the hollow interior, the swing assembly comprising a base plate fastened to the shell, a support frame disposed on the base plate, a lamp bead disposed on the support frame, and a swing frame hung on the support frame;

wherein the base plate comprises a groove for mounting an electromagnet;

the support frame comprises a first rod disposed on the base plate adjacent to the groove, the first rod extending in a direction along the longitudinal axis and forming a top end for mounting the lamp bead;

the support frame further comprises a second rod extending transversely with respect to the first rod, wherein one end of the second rod being integrated with a side edge of the first rod, and the other end of the second rod being a free end;

the swing frame is hung on the second rod; a lens is disposed on the swing frame; and when in use, the light emitted from the lamp bead propagates through the lens and illuminates the flame body.

2. The lampshade of claim 1, wherein the shell comprises an inner wall and an outer wall; the hollow interior is confined by the inner wall and is in a shape of a column; the inner wall of the shell comprises a vertical limit groove, and the outer wall of the shell comprises a vertical notch and a horizontal notch perpendicular to the vertical notch.

3. The lampshade of claim 1, wherein a part of the second rod abutting against an inner surface of the swing frame comprises a recess.

4. The lampshade of claim 1, wherein the swing frame comprises a top portion and a bottom portion; the lens is disposed on the top portion; a pendulum is disposed on the bottom portion and comprises a magnet; the magnet and the electromagnet are disposed oppositely to each other.

5. The lampshade of claim 1, wherein the lamp bead is slanted with respect to the longitudinal axis and the angle formed by the lamp bead and the longitudinal axis is of between 20°-40°.

6. The lampshade of claim 1, wherein the first rod comprises a podium projecting in a direction opposite to the second rod; at least part of the shell is disposed on the podium.

* * * * *